US012285063B2

(12) United States Patent
O'Leary

(10) Patent No.: US 12,285,063 B2
(45) Date of Patent: Apr. 29, 2025

(54) SYSTEMS AND METHODS OF MODIFYING A BODY OF FABRIC

(71) Applicant: CO GEAR PTY LTD, Queensland (AU)

(72) Inventor: Kym Lennette O'Leary, Queensland (AU)

(73) Assignee: THE HMZ COMPANY PTY LTD, Harristown (AU)

( * ) Notice: Subject to any disclaimer, the term of this patent is extended or adjusted under 35 U.S.C. 154(b) by 6 days.

(21) Appl. No.: 18/024,328

(22) PCT Filed: Jul. 29, 2021

(86) PCT No.: PCT/AU2021/050824
§ 371 (c)(1),
(2) Date: Mar. 2, 2023

(87) PCT Pub. No.: WO2022/051795
PCT Pub. Date: Mar. 17, 2022

(65) Prior Publication Data

US 2023/0276875 A1 Sep. 7, 2023

(30) Foreign Application Priority Data

Sep. 8, 2020 (AU) ..... 2020903205

(51) Int. Cl.
*A41D 15/00* (2006.01)
*A47H 23/04* (2006.01)
(Continued)

(52) U.S. Cl.
CPC ..... *A41D 15/002* (2013.01); *A47H 23/04* (2013.01); *A41D 13/0543* (2013.01); *A41F 19/005* (2013.01)

(58) Field of Classification Search
CPC ..... A41D 15/002; A41D 15/0543; A41D 13/0543; A47H 23/04; A41F 19/005
(Continued)

(56) References Cited

U.S. PATENT DOCUMENTS 560,683 A * 5/1896 Bruckner ..... A41D 15/002 D2/742
811,662 A * 2/1906 Puryear ..... A41F 19/005 2/269

(Continued)

FOREIGN PATENT DOCUMENTS

CH 524967 A 7/1972
GB 1159113 A 7/1969

(Continued)

OTHER PUBLICATIONS

English Translation of KR20100121045A (Year: 2009).*
The Extended European Search Report dated Jan. 31, 2024 corresponding to application No. 21865377.2.

*Primary Examiner* — Khaled Annis
*Assistant Examiner* — Dakota Marin
(74) *Attorney, Agent, or Firm* — Nath, Goldberg & Meyer; Joshua B. Goldberg

(57) ABSTRACT

Systems and methods of adjusting a length of fabric are disclosed. In one form, a system is disclosed for adjusting a length of fabric, said system including: a fabric body having at least one edge portion; at least one extension piece of fabric having an inner edge portion and an opposed outer edge portion and extending distally away from the at least one edge portion in an edge portion to edge portion arrangement. The at least one extension piece is sewn to the at least one edge portion with at least one release thread and at least one tab operably associated with an end of the at least one thread. The length of fabric is adjusted by moving the at least one tab and pulling the at least one release thread to release (Continued)

and separate the at least one extension piece from the fabric body.

19 Claims, 8 Drawing Sheets

(51) Int. Cl.
*A41D 13/05* (2006.01)
*A41F 19/00* (2006.01)

(58) Field of Classification Search
USPC ..... 2/269
See application file for complete search history.

(56) References Cited

U.S. PATENT DOCUMENTS 1,012,897 A * 12/1911 Nathan ..... A41D 1/06 2/232
2,124,193 A * 7/1938 Hennessy ..... A41B 9/06 2/73
2,227,214 A * 12/1940 Bisberg ..... A41D 15/002 2/269
2,371,039 A 3/1945 Fischel
2,524,814 A * 10/1950 Leaf ..... A41D 1/06 2/232
2,724,120 A * 11/1955 Biern ..... A41D 15/002 2/269
3,845,506 A 11/1974 Harris
4,149,275 A * 4/1979 Sanchez ..... A41D 1/06 2/269
4,200,938 A * 5/1980 LeTourneau ..... A41D 1/06 2/269
4,215,435 A * 8/1980 Miele ..... A41D 15/002 2/269
4,259,751 A * 4/1981 Drmaj ..... A41D 11/00 2/269
5,067,179 A * 11/1991 Wormser ..... A41D 10/00 2/269
5,088,128 A * 2/1992 Kape ..... A41D 1/06 2/919
5,774,892 A * 7/1998 Tisdale ..... A41D 15/00 2/69
6,055,673 A * 5/2000 McCormick ..... A41D 1/06 2/232
6,654,968 B2 * 12/2003 Braun ..... A41D 27/10 2/269
7,650,650 B2 * 1/2010 Voege ..... A41D 1/04 2/125
9,089,174 B1 * 7/2015 Michaelis ..... A41D 13/0015
10,285,458 B2 * 5/2019 Mazzarolo ..... A41D 1/08
10,660,380 B1 * 5/2020 Wendling ..... A41D 1/06
11,116,263 B2 * 9/2021 Czajka ..... A41D 13/12
2005/0037844 A1 * 2/2005 Shum ..... A63F 13/212 463/36
2007/0169250 A1 * 7/2007 Maniguet ..... A41D 15/002 2/227
2009/0205550 A1 * 8/2009 George ..... A41D 27/24 112/475.24
2017/0006941 A1 * 1/2017 Meyer ..... A41D 15/002
2018/0092413 A1 * 4/2018 Reyes ..... A41D 1/06
2018/0103693 A1 * 4/2018 Reagan ..... A41D 15/002
2018/0242661 A1 * 8/2018 Giese ..... A41D 1/08
2021/0392976 A1 * 12/2021 Johnson ..... A41D 11/00

FOREIGN PATENT DOCUMENTS

JP 2002249904 A 9/2002
KR 20100121045 A * 5/2009

* cited by examiner

SYSTEMS AND METHODS OF MODIFYING A BODY OF FABRIC

This is a National Phase Application filed under 35 U.S.C. 371 as a national stage of PCT/AU2021/050824, filed Jul. 29, 2021, an application claiming the benefit of Australian Application No. 2020903205, filed Sep. 8, 2020, the content of each of which is hereby incorporated by reference in its entirety.

TECHNICAL FIELD

The present invention relates to systems and methods of modifying a body of fabric, including adjusting a length of a fabric, such as, e.g., a garment, a curtain, a tablecloth or a tarpaulin, or adding and/or removing an embellishment.

BACKGROUND

Fabric items, such as, e.g., curtains, tablecloths, tarpaulins and particularly garments, are generally provided in a range of distinct sizes. Typically, a consumer will select one or more desired sizes of the fabric item.

However, a problem with the above practice is that it is not uncommon for none of the distinct sizes to fit. For example, it is common for none of the sizes of a garment to fit an individual. In such instances, the garment must be specifically adjusted to fit the individual, which usually involves lengthening or shortening a hem of the garment or even in some instances bespoke tailoring.

The above problem is further compounded when bulk orders of such fabric items are placed, such as, e.g., by an employer, a mine site, a school or a sporting team. In such scenarios, it is particularly common for none of the ordered fabric items to fit one or more individuals or objects and/or for there to be an undersupply of desired sizes and an oversupply of non-desired sizes of the fabric item. This problem is not limited to end consumers but is also a problem that most retailers and manufacturers face when placing orders and commencing a manufacturing cycle.

A further and resultant problem with the undersupply of desired sizes and oversupply of non-desired sizes is the expense and delays associated with the returning of the non-desired sizes and re-ordering of the desired sizes.

Of course, one or more of the above problems may be at least partially addressed by measuring each individual or object prior to placing a bulk order or commencing a manufacturing cycle. However, this would take a considerable amount of time, is not always possible and is certainly not convenient. For example, it is generally not possible for retailers or manufacturers to individually measure each consumer or object prior to placing a bulk order or commencing a manufacturing cycle. Rather, both the retailer and manufacturer are faced with the uncertainty of guessing how many of each fabric item to order or manufacture.

Garments have been developed that are manufactured and sold in one size only and are intended to be altered by the end user. However, the present inventor has found that such garments are generally deficient.

For example, Australian Patent No. 2010201143 B2 discloses a multi-length garment in which the end user has to actively cut the garment to a desired length. However, apart from a reluctance to permanently cut a newly purchased garment to the desired length, the present inventor has found that the garments are prone to fraying and have a generally untidy appearance, particularly if the end user does not cut the garment correctly.

It will be clearly understood that, if a prior art publication is referred to herein, this reference does not constitute an admission that the publication forms part of the common general knowledge in the art in Australia or in any other country.

SUMMARY OF INVENTION

Embodiments of the present invention provide adjustable fabric length systems, modification systems and methods of use thereof, which may at least partially address one or more of the problems or deficiencies mentioned above or which may provide the public with a useful or commercial choice.

According to a first aspect of the present invention, there is provided an adjustable fabric length system for adjusting a length of fabric, said system including:

a fabric body having at least one edge portion;

at least one extension piece of fabric having an inner edge portion and an opposed outer edge portion, said at least one extension piece extending distally away from the at least one edge portion in an edge portion to edge portion arrangement, said at least one extension piece sewn to the at least one edge portion with at least one release thread; and at least one tab operably associated with an end of the at least one release thread, said at least one tab adapted to cover the end of the at least one release thread, wherein the length of fabric is adjusted by moving the at least one tab and pulling the at least one release thread to release and separate the at least one extension piece from the fabric body.

According to a second aspect of the present invention, there is provided an adjustable fabric length system for adjusting a length of fabric, said system including:

a fabric body having at least one edge portion; and a plurality of extension pieces of fabric, each extension piece having an inner edge portion and an opposed outer edge portion, said plurality of extension pieces sewn together with one another and the fabric body in an edge portion to edge portion arrangement such that the plurality of extension pieces extend distally away from the at least one edge portion of the fabric body, each said extension piece individually sewn to an adjacent said extension piece or the at least one edge portion with at least one release thread, wherein the length of fabric is adjusted by pulling the at least one release thread associated with a selected said extension piece to release and separate the selected said extension piece from the fabric body or the outer edge portion of a proximally arranged said extension piece.

According to a third aspect of the present invention, there is provided an adjustable fabric length system for adjusting a length of fabric, said system including:

a fabric body having at least one edge portion; and a plurality of extension pieces of fabric, each extension piece having an inner edge portion and an opposed outer edge portion, said plurality of extension pieces adapted to be sewn together with one another and the fabric body in an edge portion to edge portion arrangement such that the plurality of extension pieces extend distally away from the at least one edge portion of the fabric body, each said extension piece adapted to be individually sewn to an adjacent extension piece or the at least one edge portion with at least one release thread, wherein the length of fabric is shortened by pulling the at least one release thread associated with a selected said extension piece to release and separate the selected said extension piece from the fabric body or the outer edge portion of a proximally arranged said extension piece, and wherein the length of fabric is lengthened by sewing at least one said extension piece to the fabric body or the outer edge portion of a proximally arranged said extension piece, said at least one said extension piece being individually sewn with said at least one release thread.

Preferably, the length of fabric is lengthened by releasably sewing individual extension pieces to the fabric body or the outer edge portion of a proximally arranged said extension piece.

Advantageously, the present invention provides a system for adjusting a length of fabric, such as, e.g., a garment, to a desired length by simply pulling the at least one release thread associated with a selected extension piece to remove the selected extension piece or by the selective addition of one or more extension pieces. When removing, the selected extension piece is cleanly released and separated from a remainder of the garment without the need for cutting thereby leaving a cleaner and tidier garment. Consequently, retailers and manufacturers can provide garments and other fabric items in a single size and end users can alter the garments or fabric items at their end to a desired size. Apart from being convenient to all parties involved, the system reduces waste associated with the supply of non-desired, under or oversized garments; reduces environmental pollution associated with the manufacturing, transportation and warehousing of garments in multiple sizes; and reduces the amount of packaging associated again with the supply of garments in multiple sizes.

As indicated above, the system of the present invention is for adjusting a length of fabric. In some embodiments, the system is for shortening the length of fabric to a desired length through the removal of one or more extension pieces of fabric. In other embodiments, the system is for lengthening the length of fabric to a desired length through the selective addition of one or more extension pieces of fabric.

As used herein, the term "fabric" may include any material made of interlacing fibres through a process of weaving, knitting, spreading, felting, stitching, crocheting, bonding or the like. The fibres may include natural or synthetic fibres, or a combination thereof.

The fabric body may include processed and unprocessed fabric items. Examples of processed fabric items may include garments, clothes, curtains, tablecloths, tarpaulins, flags, handkerchiefs, window shades, towels, bed sheets, bed spreads and covers, furniture covers, and other like covers. An unprocessed fabric item may include a piece or sheet of fabric, such as, e.g., a roll of fabric, for making processed fabric items.

The fabric body may be of any suitable size and shape and may be formed from any suitable fibre or combination of fibres.

The fabric body may usually have at least one edge portion. For example, in some embodiments the fabric body may include a garment or part thereof and the at least one edge portion may include an edge of the garment or part thereof, such as, e.g., a sleeve, a hem, a cuff, a placket, an opening, or a collar.

In other embodiments in which the fabric body is a fabric item other than a garment, the edge portion may be any edge of a sheet of the fabric material, such as, e.g., a side edge portion or an end edge portion of a curtain, window shade, bed spread, or table cloth.

Typically, the fabric body may include more than one edge portion. For example, the fabric body may include one or more opposed side edge portions and/or one or more opposed end edge portions.

Preferably, the at least one edge portion may include a hem.

As indicated, the fabric body may include at least one extension piece of fabric releasably sewn to the at least one edge portion of the fabric body.

In some embodiments, the fabric body may include a plurality of extension pieces releasably sewn to the at least one edge portion of the fabric body.

Each extension piece may be of any suitable size, shape and construction. Typically, each extension piece may be sized, shaped and constructed to distally extend away from the at least one edge portion of the fabric body.

Suitably, each extension piece may be in the form of a cuff or strip.

Each extension piece may include opposing edge portions, typically at least a pair of opposed edge portions, preferably opposed edge portions extending between opposed end edge portions. The opposed end edge portions may be joined together to define a cuff or may be free to define a strip.

The opposed edge portions may include an inner edge portion adapted to be releasably sewn to the at least one edge portion of the fabric body or an adjacently arranged extension piece and an opposed outer edge portion. Typically, at least one of the opposed edge portions may include a hem, preferably both edge portions.

As indicated, the plurality of extension pieces may be adapted to be releasably sewn together with one another and the fabric body in an edge portion to edge portion arrangement such that the plurality of extension pieces extend distally away from the at least one edge portion of the fabric body. Preferably, partially overlapping portions of the edge portions of adjacently arranged extension pieces and/or the fabric body may be releasably sewn together.

For example, in some embodiments in which the fabric body is a garment, such as, e.g., a pair of pants or trousers, the plurality of extension pieces may each be in the form of a cuff forming part of the legs of the pants or trousers, typically forming at least a distal part or portion of the legs of the pants or trousers.

Likewise, in some embodiments in which the fabric body is a shirt or jacket, the plurality of extension pieces may each be in the form of a cuff forming at least part of the arms of the shirt or jacket, typically forming at least a distal part or portion of the arms of the shirt or jacket.

In other embodiments, the extension pieces may be in the form of a strip forming at least part of a lower edge or hem of a fabric body, such as, e.g., a shirt, a jacket, a dress or a skirt.

In yet other embodiments in which the fabric body is an item other than a garment, the plurality of extension pieces may each be in the form of strips distally extending away from the at least one edge portion of the fabric body.

The fabric body and the plurality of extension pieces may be releasably sewn together in any suitable way such that the extension pieces may be selectively removed.

Generally, the fabric body and the plurality of extension pieces may be releasably sewn together with at least one release thread such that an extension piece may be separated and removed from an adjacently positioned extension piece and/or the fabric body by pulling the at least one release thread, preferably an end of the at least one release thread.

Typically, the fabric body and the plurality of extension pieces may be releasably sewn together with a sewing machine, although hand sewing is also envisaged.

In some embodiments, each extension piece may be releasably sewn to an adjacent extension piece and/or the fabric body using a loop stitch and a single release thread. The loop stitch may include a chain stitch, a lock stitch, a cover stitch or any other type of loop stitch that includes a single release thread.

In other embodiments, each extension piece may be releasably sewn to an adjacent extension piece and/or the fabric body using a double loop stitch and two release threads, preferably a double chain stitch and two release threads.

The at least one release thread may be of any suitable size, shape, colour and construction and may be formed from any suitable material or materials to releasably connect the fabric body and the plurality of extension pieces.

Typically, the at least one release thread may be formed from natural or synthetic fibres or a combination thereof. The release thread may typically include a pair of opposed ends and may extend longitudinally between the opposed ends.

In some embodiments, the at least one release thread may include a visual indicator to distinguish the release thread from other threads. For example, the release thread may be coloured or may include a combination of colours. In some such embodiments, the release thread may include a bright and readily visible colour, such as, e.g., a fluorescent orange, yellow or green colour. In other such embodiments, the release thread may be striped.

In some embodiments, the respective release threads associated with each extension piece may include visual indicators to distinguish the release thread from release threads associated with other extension pieces. Again, the release thread may be coloured or may include a combination of colours, for example. In some such embodiments, the release thread may include a bright and readily visible colour, such as, e.g., white, or a fluorescent orange, yellow or green colour. In other such embodiments, the release thread may be patterned or striped.

In some embodiments, each extension piece may be releasably sewn to an adjacent extension piece and/or the fabric body with two or more lines of loop stitches extending substantially parallel to one another. Each line of loop stitches may preferably include a single release thread.

In preferred embodiments, the system may include at least one tab operatively associated with an end of the at least one release thread.

The at least one tab may be of any suitable size, shape and construction and may be formed from any suitable material or materials.

Typically, the at least one tab may be of a size and shape to at least partially cover an outer end of the at least one release thread and prevent the at least one release thread from being inadvertently pulled. Preferably, the at least one tab may be a pull tab and may be adapted to be pulled by a user to thereby pull the end of the at least one release thread to selectively release and separate an extension piece from the fabric body.

In some embodiments, the at least one tab may be formed from a piece of fabric. In other embodiments, the at least one tab may be formed from plastic material or materials.

The at least one tab may be operatively associated with the end of the at least one release thread in any suitable way, preferably an outer end of the at least one release thread.

For example, in some embodiments, the end of the at least one release thread and the at least one tab may be connected together by one or more fasteners. The one or more fasteners may include one or more mechanical fasteners (such as, e.g., a staple, a pin or a tack) and/or one or more chemical fasteners (such as, e.g., a wet adhesive, a dry adhesive or double-sided adhesive tape).

Likewise, when covering the end of the at least one release thread, the at least one tab may be affixed or fastened to the extension piece to prevent the tab becoming loose and inadvertently pulling on the release thread, preferably releasably fastened. The at least one tab and the extension piece may be fastened together in any suitable way such that the end of the release thread is positioned and concealed therebetween.

For example, in some embodiments, the at least one tab may be fastened to an extension piece with one or more chemical fasteners, such as, e.g., a wet adhesive, a dry adhesive or double-sided adhesive tape.

In other embodiments, the at least one tab may be fastened to an extension piece with one or more mechanical fasteners, such as, e.g., a staple, a pin or a tack.

In yet other embodiments, the at least one tab may be bonded to an extension piece.

In further embodiments, the at least one tab may be sewn to the extension piece, typically with one or more stitches along the edges of the at least one tab. In such embodiments, the edges of the tab may be configured to tear and release the one or more stitches when the at least one tab is pulled or separated away from the extension piece.

For example, in some such embodiments, the edges of the at least one tab may include one or more frangible portions configured to facilitate the tearing of the edges and releasing of the stitches when the at least one tab pulled or separated away from the extension piece.

In some embodiments, the at least one tab may include one or more markings or symbols. The markings or symbols may include instructions for use, for example.

According to a fourth aspect of the present invention, there is provided a system for modifying a body of fabric, said system including:

- a fabric body;
- at least one piece of fabric piece sewn to the fabric body with at least one release thread; and
- at least one tab operably associated with an end of the at least one release thread,
- wherein the at least one piece of fabric is removed from the fabric body by pulling the at least one tab associated with the at least one fabric piece to release and separate the at least one fabric piece from the fabric body, and
- wherein the at least one tab is adapted to cover the end of the at least one release thread and prevent the at least one release thread from being inadvertently pulled.

The system may include one or more features or characteristics of the adjustable fabric length system as hereinbefore described.

The at least one piece of fabric may include any fabric piece sewn to the fabric body.

For example, in some embodiments, the at least one piece of fabric may include a high visibility piece of fabric, such as, e.g., a piece of fabric coloured to be readily discernible from any background. Examples of such colours include fluorescent yellow, fluorescent orange or fluorescent green.

In other embodiments, the at least one piece of fabric may include a reflective material.

According to a fifth aspect of the present invention, there is provided a method of adjusting a length of fabric, said method including:

providing a fabric body having at least one edge portion and at least one extension piece of fabric having an inner edge portion and an opposed outer edge portion, said at least one extension piece extending distally away from the at least one edge portion in an edge portion to edge portion arrangement, said at least one extension piece sewn to the at least one edge portion with at least one release thread; and pulling the at least one release thread to release and separate the at least one extension piece from the fabric body.

According to a sixth aspect of the present invention, there is provided a method of adjusting a length of fabric, said method including:

providing a fabric body having at least one edge portion and a plurality of extension pieces of fabric, each extension piece having an inner edge portion and an opposed outer edge portion, said plurality of extension pieces sewn together with one another and the fabric body in an edge portion to edge portion arrangement such that the plurality of extension pieces extend distally away from the at least one edge portion of the body, each said extension piece individually sewn to an adjacent said extension piece or the at least one edge portion with at least one release thread; and pulling the at least one release thread associated with a selected said extension piece to release and separate the selected said extension piece from the fabric body or the outer edge portion of a proximally arranged said extension piece.

According to a seventh aspect of the present invention, there is provided a method of adjusting a length of fabric, said method including:

providing a fabric body having at least one edge portion and a plurality of extension pieces of fabric, each extension piece having an inner edge portion and an opposed outer edge portion, said plurality of extension pieces adapted to be sewn together with one another and the fabric body in an edge portion to edge portion arrangement such that the plurality of extension pieces extend distally away from the at least one edge portion of the body, each said extension piece adapted to be individually sewn to an adjacent said extension piece or the at least one edge portion with at least one release thread; and individually sewing one or more said extension pieces to the fabric body or the outer edge portion of a proximally arranged said extension piece until a desired length is reached, said one or more extension pieces being individually sewn with said at least one release thread.

The methods of the fifth to seventh aspects may include one or more features or characteristics of the systems hereinbefore described.

The methods of the fifth and sixth aspects correspond to methods of adjusting a length of fabric by shortening the length of fabric. Conversely, the method of the seventh aspect corresponds to a method of lengthening the length of fabric.

For example, in some embodiments the providing may include providing the system of the first, second or third aspects.

In some embodiments, the method may adjust a length of fabric by shortening the length of fabric through selective removal of one or more extension pieces.

In other embodiments, the method may adjust a length of fabric by lengthening the length of fabric through selective addition of one or more extension pieces. The one or more extension pieces may be releasably sewn to the fabric body or the outer edge portion of a proximally arranged said extension piece until a desired length is reached.

As indicated, the fabric body may include processed and unprocessed fabric items having at least one edge portion.

In some embodiments, the fabric body may include garments, clothes, curtains, tablecloths, tarpaulins, flags, handkerchiefs, window shades, towels, bed sheets, bed spreads and covers, furniture covers, and other like covers.

In other embodiments, the fabric body may include a piece or sheet of fabric, such as, e.g., a roll or bolt of fabric, for making processed fabric items.

The at least one extension piece of fabric releasably sewn to the at least one edge portion of the fabric body may preferably include a plurality of extension pieces. The plurality of extension pieces may be arranged in an edge portion to edge portion arrangement such that the plurality of extension pieces extend distally away from the at least one edge portion of the fabric body. Preferably, partially overlapping portions of the edge portions of adjacently arranged extension pieces and/or the fabric body may be releasably sewn together.

Typically, each extension piece may be sized, shaped and constructed to distally extend away from the at least one edge portion of the fabric body.

Suitably, each extension piece may be in the form of a cuff or strip.

The pulling may include identifying an end of the at least one release thread with a selected said extension piece to be released and separated.

In some embodiments, the identifying may include identifying a visual indicator associated with the at least one release thread, such as, e.g., a bright and readily visible colour.

In other embodiments, the identifying may include locating at least one tab operatively associated with the end of the at least one release thread.

In such embodiments, the pulling may further include separating or detaching the at least one tab from the selected said extension piece.

The pulling may preferably include pulling the at least one release thread entirely from the selected said extension piece to release and separate the extension piece from the fabric body or the outer edge portion of a proximally arranged said extension piece. In preferred embodiments, the at least one release thread may be pulled via the at least one tab.

The individually sewing may preferably include releasably sewing each said extension piece to the fabric body or the outer edge portion of a proximally arranged said extension piece with a sewing machine or by hand.

Any of the features described herein can be combined in any combination with any one or more of the other features described herein within the scope of the invention.

The reference to any prior art in this specification is not and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows.

DETAILED DESCRIPTION

FIGS. 1A to 1E show an embodiment of an adjustable fabric length system (100) for adjusting a leg (900; i.e., a length of fabric) of a pair of pants.

Figure 1B:
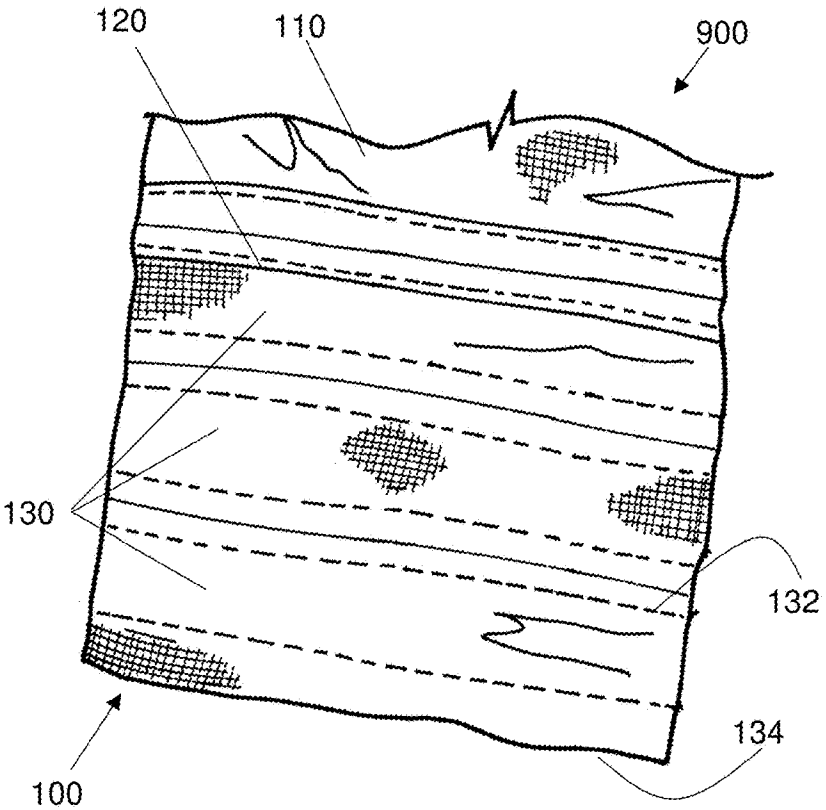
FIG. 1B is a schematic of the system as shown in FIG. 1A with the outer part of the leg shown the right way out.
Figure 1A:
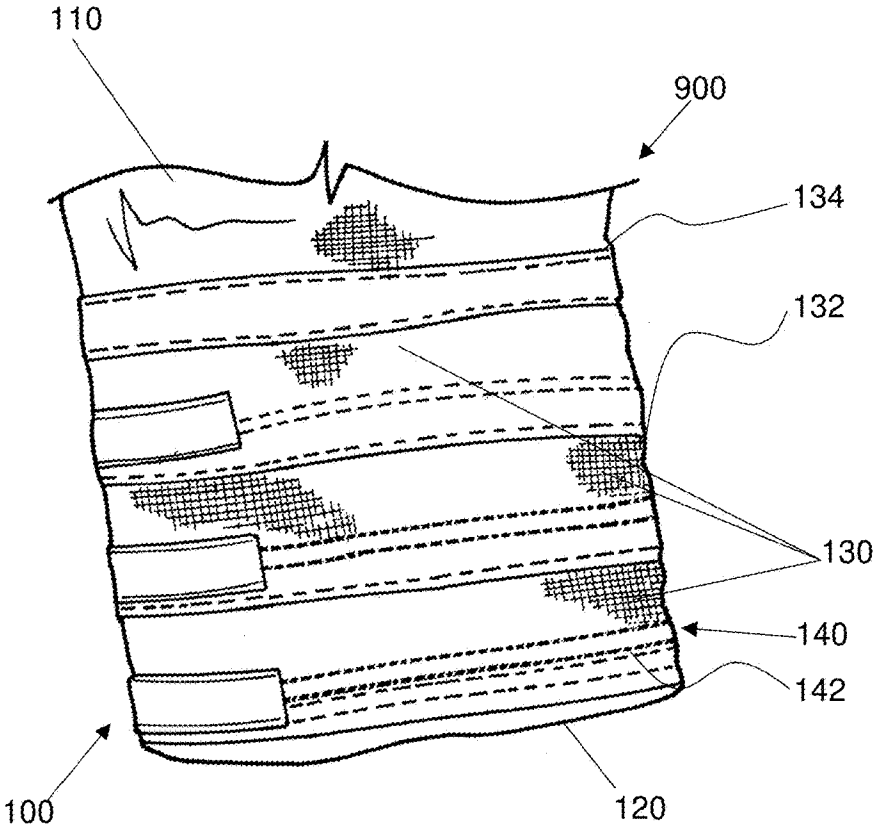
FIG. 1A is a schematic showing an adjustable fabric length system according to an embodiment of the present invention incorporated on a leg of a pair of pants with the outer part of the leg shown partially inverted.

Referring to FIG. 1A, the system (100) includes a fabric body (110) having at least one edge portion (120) and a plurality of extension pieces (130) extending distally away from the edge portion (120).

Each extension piece (130) includes opposing edge portions, including an inner edge portion (132) and an opposed outer edge portion (134).

The plurality of extension pieces (130) are releasably sewn together with one another and the fabric body (110) in an edge portion to edge portion arrangement such that the extension pieces (130) extend distally away from the at least one edge portion (120) to form the lower part of the leg (900).

As shown, each extension portion (130) is individually sewn to an adjacent edge portion (130) or the at least one edge portion (120) with at least one line of loop stitching (140). The at least one line of loop stitching (140) includes a pair of release threads (142).

Referring briefly to FIG. 1B, the length of the leg (900) of the pair of pants can be readily shortened to a desired length by: (i) selecting an extension piece (130) immediately distal the desired length of the leg (900); (ii) turning the leg (900) inside out and locating and separating the tab (150) from the selected extension piece (130) as shown in FIG. 1C to uncover the release threads (142) coloured blue; (iii) pulling the release threads (142) coloured blue as shown in FIGS. 1D and 1E from the at least one line of loop stitching (140) fastening the extension piece (130) to a remainder of the leg (900); and (iii) turning the leg (900) again the right way out as shown in FIG. 1B and removing any remaining threads of the line of loop stitching (140) to release and separate the extension piece (130) from the remainder of the leg (900).

Referring briefly to FIG. 1C, the release threads (142) are uncovered by locating and tearing the tab (150) away from the extension piece (130). The tab (150) is formed from a piece of fabric and is sewn to the extension piece (130) with lines of stitches (152) extending along its opposed side edges. The tab (150) is adapted to cover the end of the release thread (142) and prevent it from being inadvertently pulled.

When pulled away from the extension piece (130), the lines of stitches (152) are configured to tear away from the tab (150) allowing the tab (150) to be removed and uncover the underlying ends of the release threads (142).

Figure 1D:
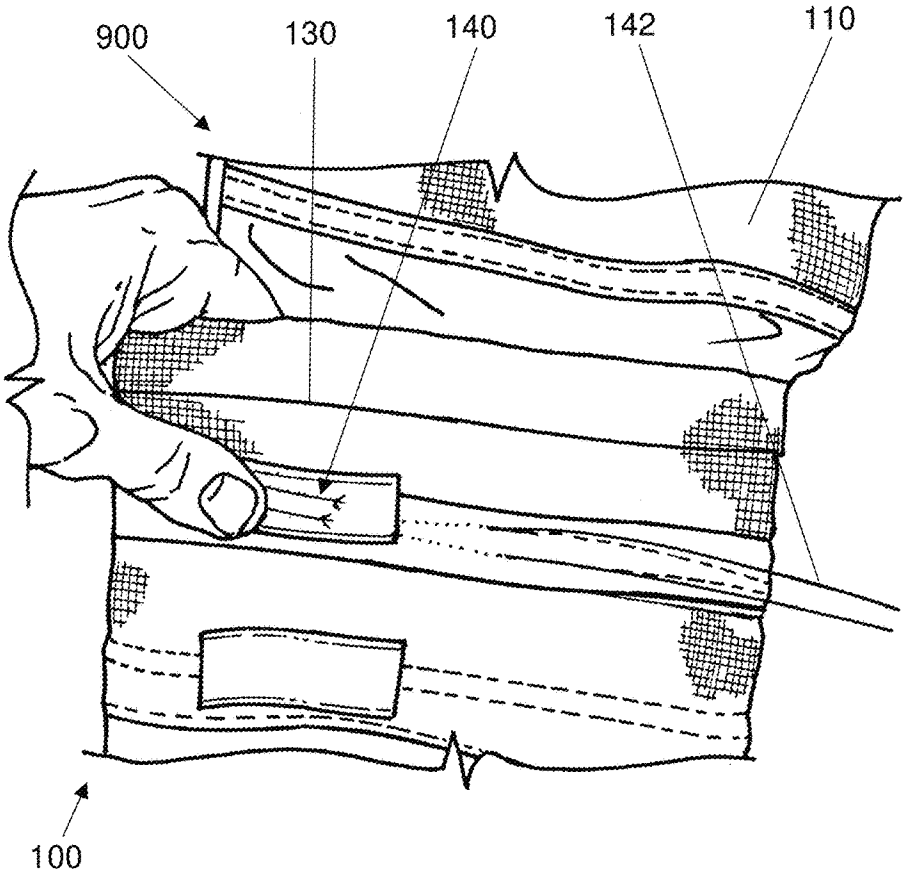
FIG. 1D is another schematic of the system as shown in FIG. 1C with the release thread partially removed.
Figure 1C:
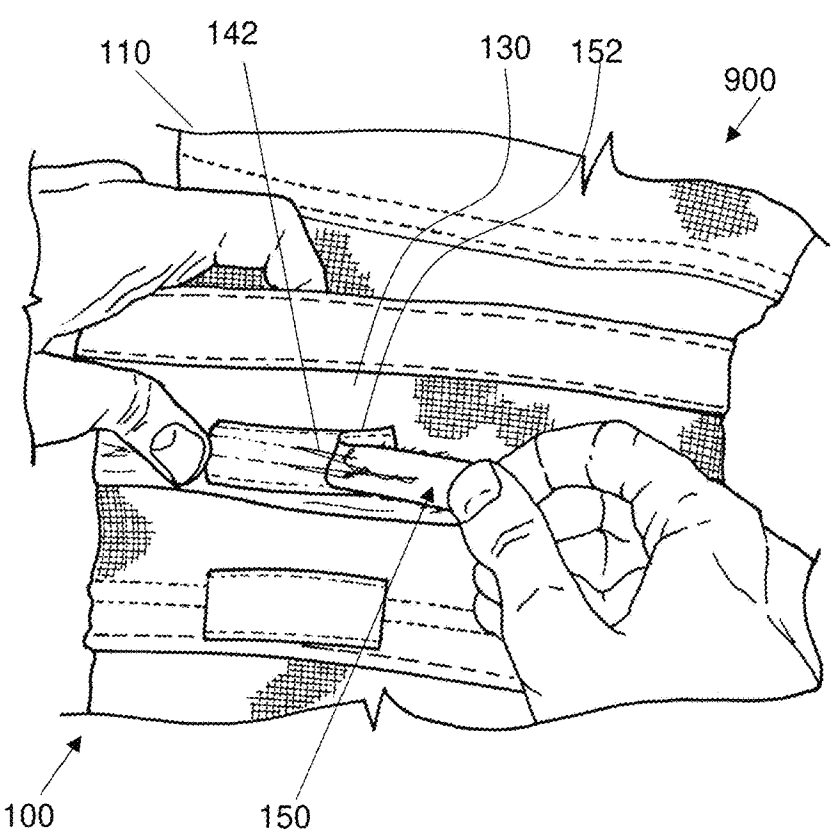
FIG. 1C is another schematic of the system as shown in FIGS. 1A and 1B with a release thread of an outermost extension piece of the system being initially removed.
Figure 1E:
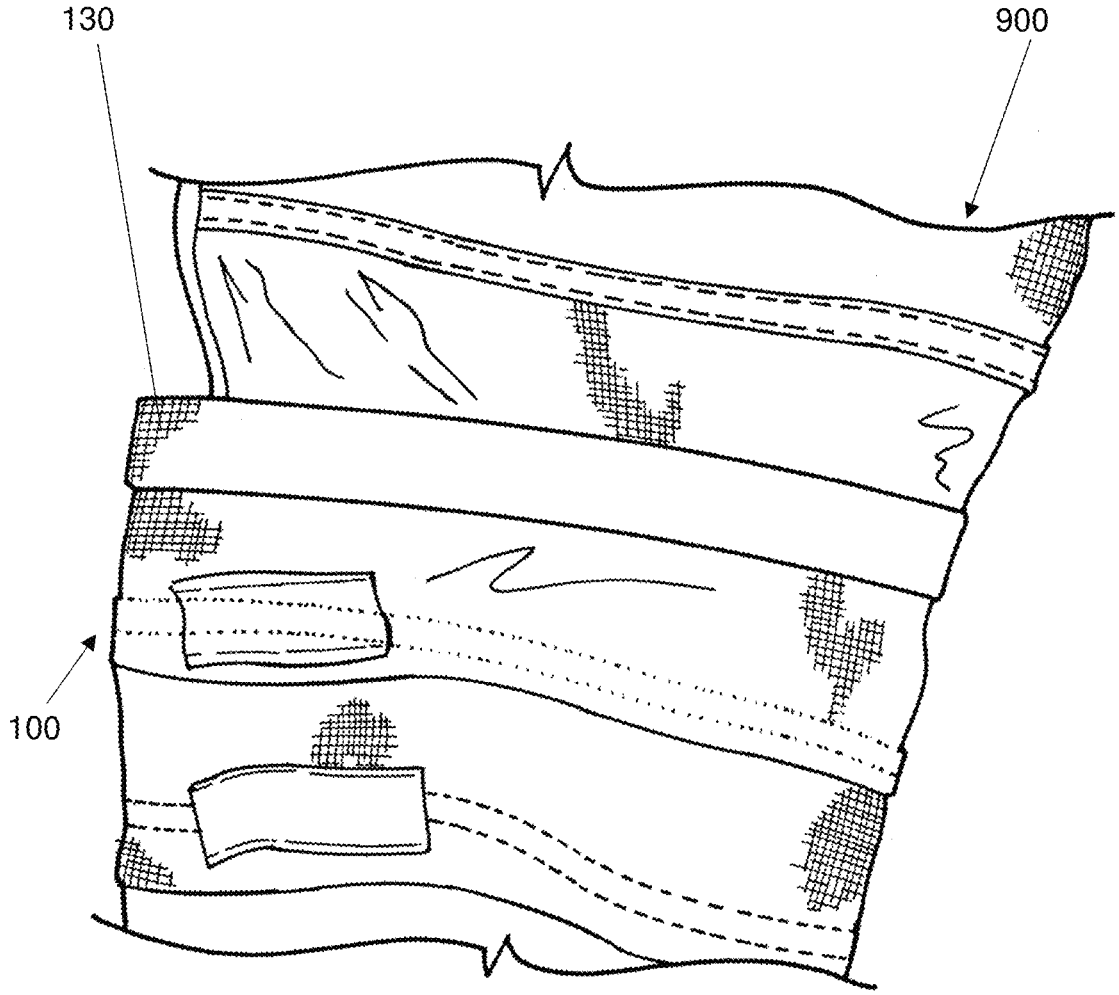
FIG. 1E is yet another schematic of the system as shown in FIGS. 1C and 1D with the release thread entirely removed.

Referring to FIGS. 1D and 1E, once uncovered, the ends of the release threads (142; shown in FIG. 1D only) are located and pulled continuously away from the leg (900) until the thread (142; shown in FIG. 1D only) is completely removed from the line of loop stitching (140) as shown in FIG. 1E.

Referring back to FIG. 1A, the fabric body (110) includes a central portion of the pair of pants and a proximal part of the leg (900) extending to the at least one edge portion (120).

The at least one edge portion (120) includes a hem.

Referring again to FIG. 1B, each extension piece (130) is in the form of a cuff of fabric.

The inner edge portion (132) of each extension piece (130) is adapted to be releasably sewn to the outer edge portion (134) of an immediately proximal extension piece (130) or the at least one edge portion (120). Each of the opposed edge portions (132, 134) of each extension piece (130) includes a hem.

As shown, the extension pieces (130) are releasably sewn together in an edge portion to edge portion arrangement such that the plurality of extension pieces (130) extend distally away from the at least one edge portion (120) of the fabric body (110) to form the leg (900). Specifically, partially overlapping portions of the edge portions (132, 134) of adjacently arranged extension pieces (130) are releasably sewn together.

Referring to FIGS. 1C and 1D, the release threads (142), shown in blue, forms part of the at least one line of loop stitch (140) joining the extension pieces (130) and the fabric body (110) together.

In some embodiments, the release threads (142) are coloured a distinguishing colour relative to other threads so as to be readily visible and distinguishable from non-release threads.

Figure 2:
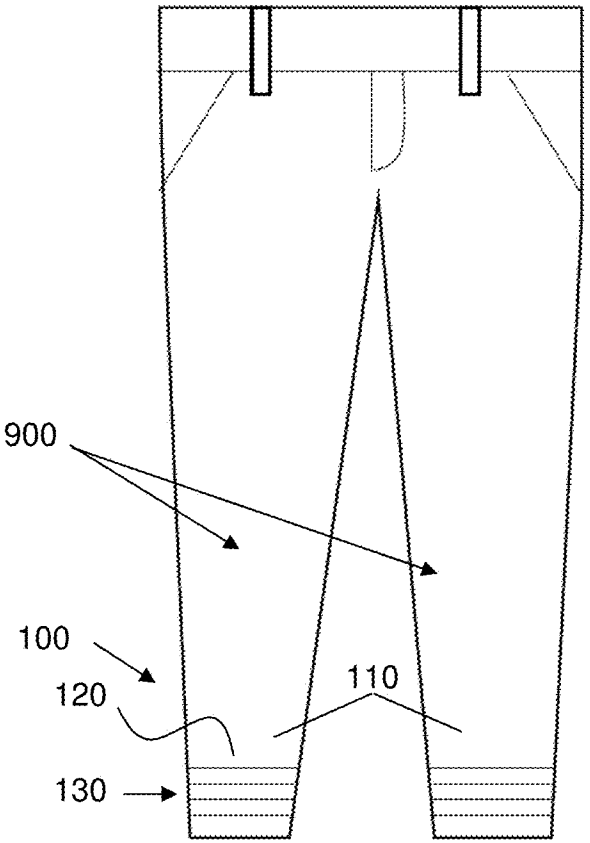
FIG. 2 is a schematic of a pair of pants incorporating the system as shown in FIGS. 1A to 1E.

FIG. 2 shows a schematic of the system (100) incorporated on each leg (900) of a pair of pants.

As shown, each leg (900) includes the same fabric body (110) each with an outer edge (120) and a plurality of extension pieces (130) extending distally away from the outer edge (120).

In use, a user may shorten each leg (900) to a desired length by releasing and separating an extension piece (130) immediately distal the desired length.

Figure 3:
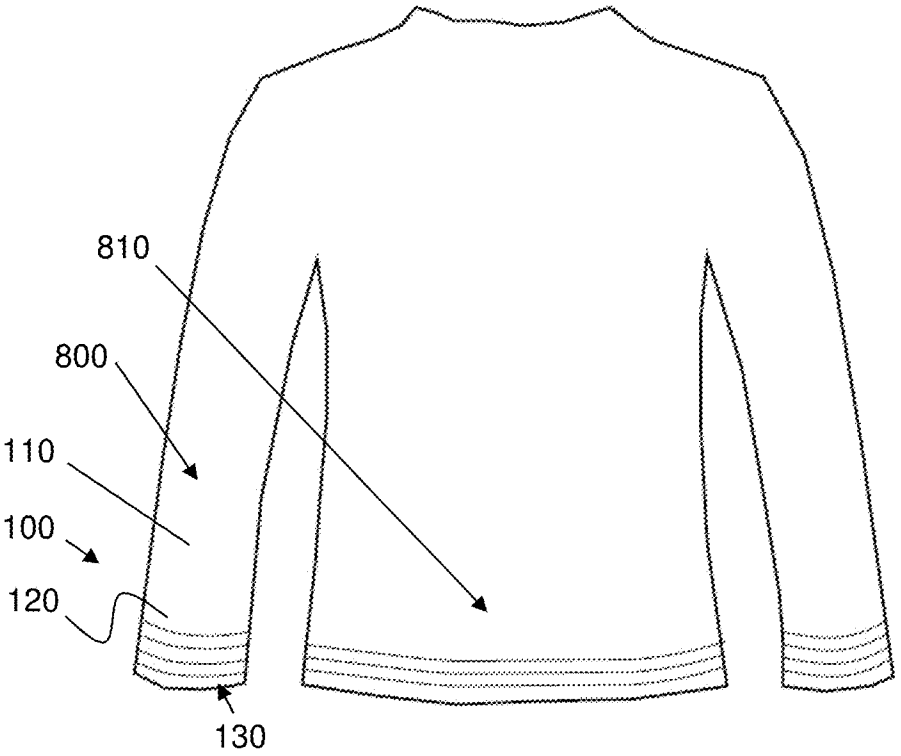
FIG. 3 is a schematic of a long-sleeved shirt incorporating the system as shown in FIGS. 1A to 1E.

FIG. 3 shows a schematic of the system (100) incorporated on each arm (800) and a lower hem (810) of a long sleeved shirt.

As shown, each arm (800) and the lower hem (810) includes the same fabric body (110) each with an outer edge (120) and a plurality of extension pieces (130) extending distally away from the outer edge (120).

In use, a user may selectively shorten each arm (800) and/or the lower hem (810) to a desired length by releasing and separating an extension piece (130) immediately distal the desired length.

Figure 4:
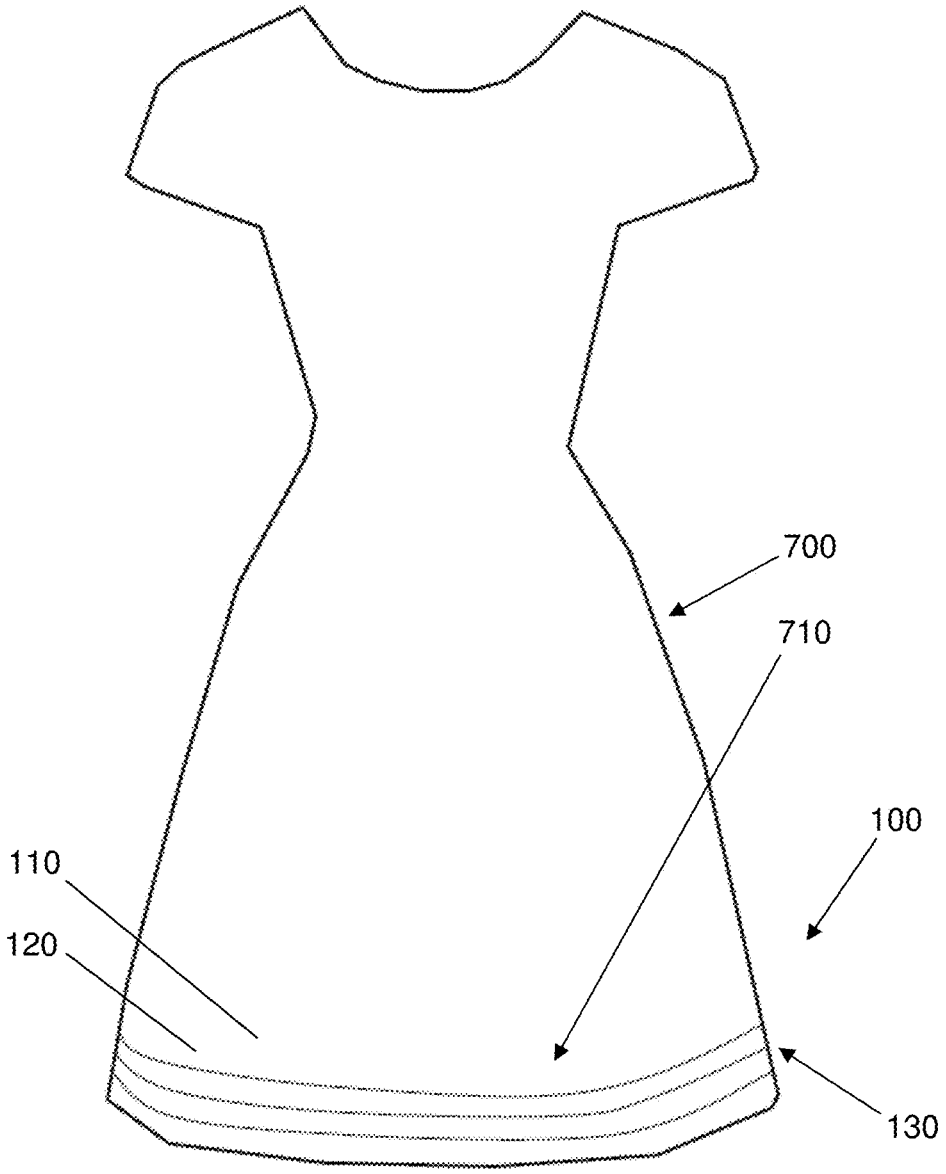
FIG. 4 is a schematic of a dress incorporating the system as shown in FIGS. 1A to 1E.

FIG. 4 shows a schematic of the system (100) incorporated on a lower hem (710) of a dress (700).

As shown, the lower hem (710) includes a fabric body (110) with an outer edge (120) and a plurality of extension pieces (130) extending distally away from the outer edge (120).

In use, a user may selectively shorten the lower hem (710) to a desired length by releasing and separating an extension piece (130) immediately distal the desired length.

Figure 5:
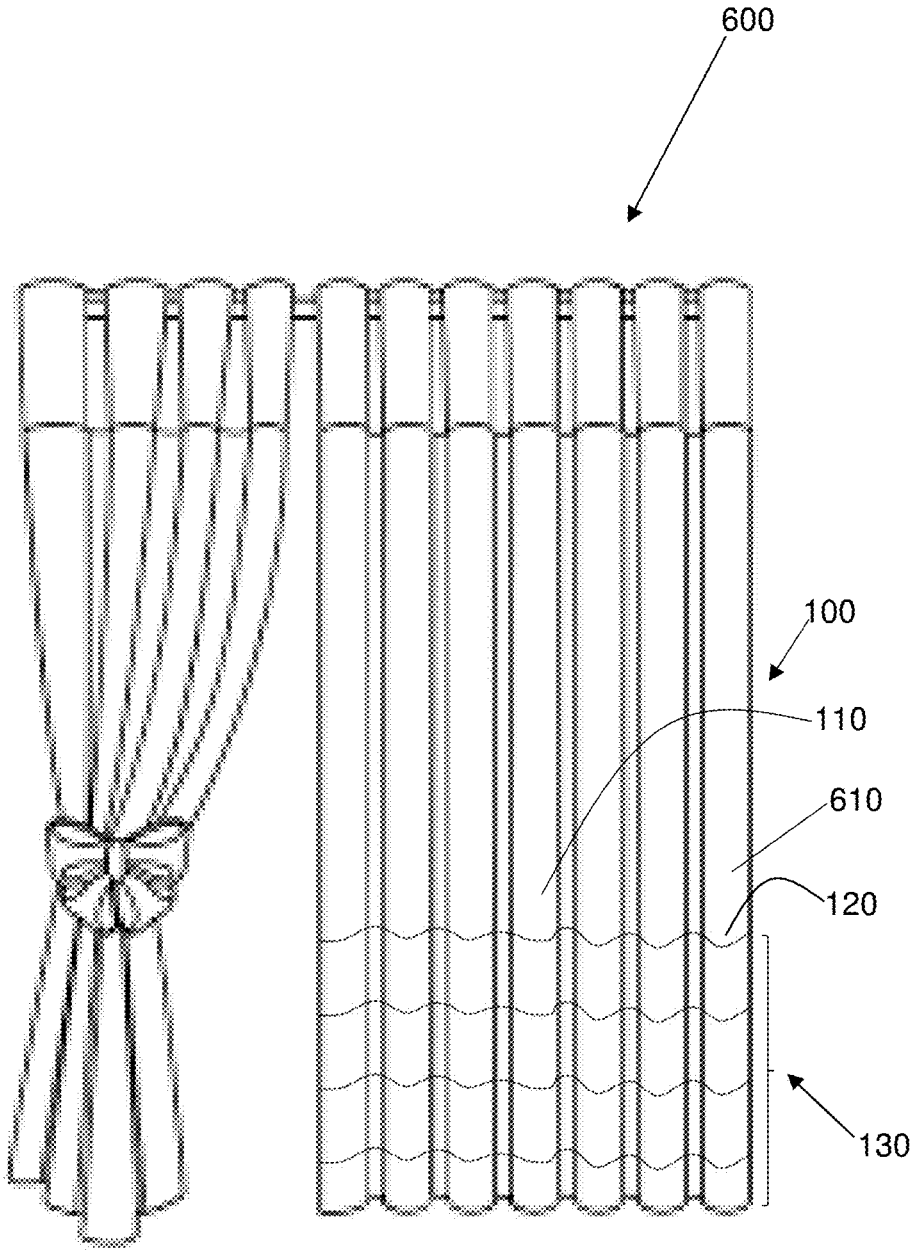
FIG. 5 is a schematic of a curtain incorporating the system as shown in FIGS. 1A to 1E.

FIG. 5 shows a schematic of the system (100) incorporated on a lower edge (610) of a curtain (600).

As shown, the lower edge (610) includes a fabric body (110) with an outer edge (120) and a plurality of extension pieces (130) extending distally away from the outer edge (120).

In use, a user may selectively shorten the curtain to a desired length by releasing and separating an extension piece (130) immediately distal the desired length.

Figure 6:
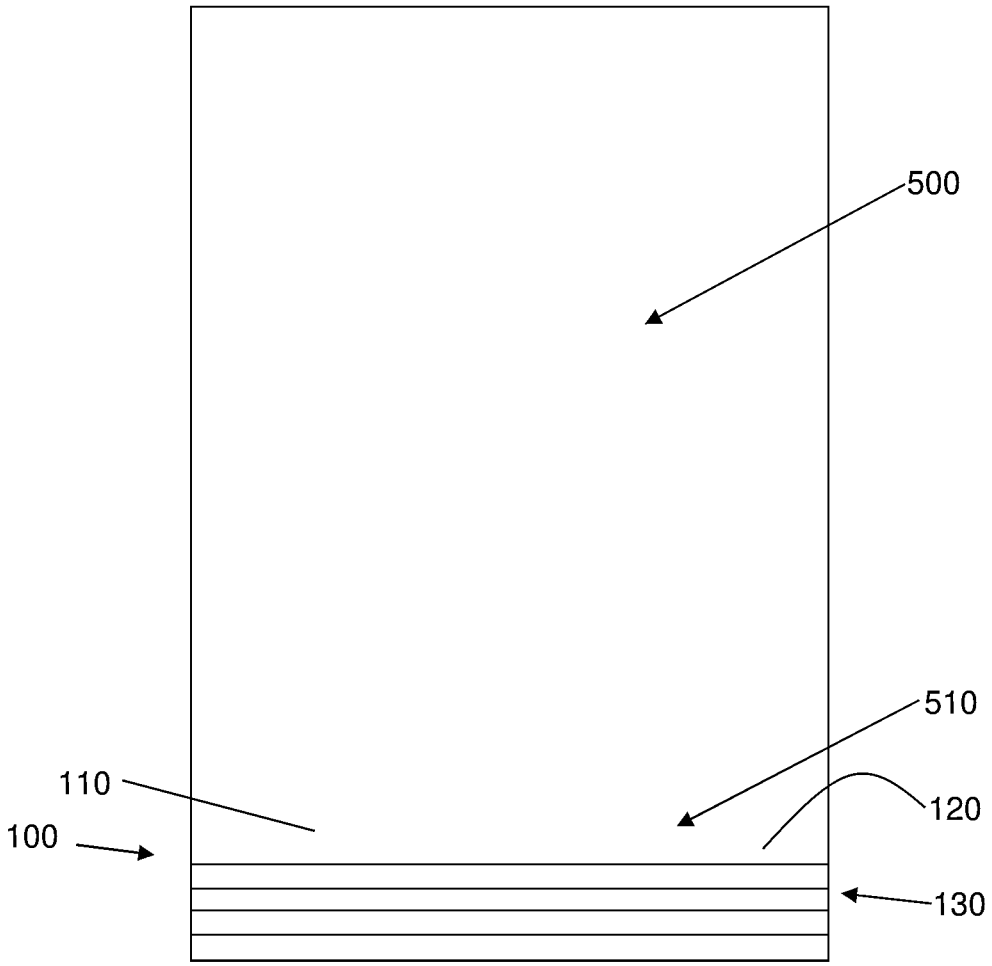
FIG. 6 is a schematic of a sheet of fabric incorporating the system as shown in FIGS. 1A to 1E.

FIG. 6 shows a schematic of the system (100) incorporated on a lower edge (510) of a sheet of fabric (500).

As shown, the lower edge (510) includes a fabric body (110) with an outer edge (120) and a plurality of extension pieces (130) extending distally away from the outer edge (120).

In use, a user may selectively shorten the sheet of fabric (500) to a desired length by releasing and separating an extension piece (130) immediately distal the desired length.

Figure 7:
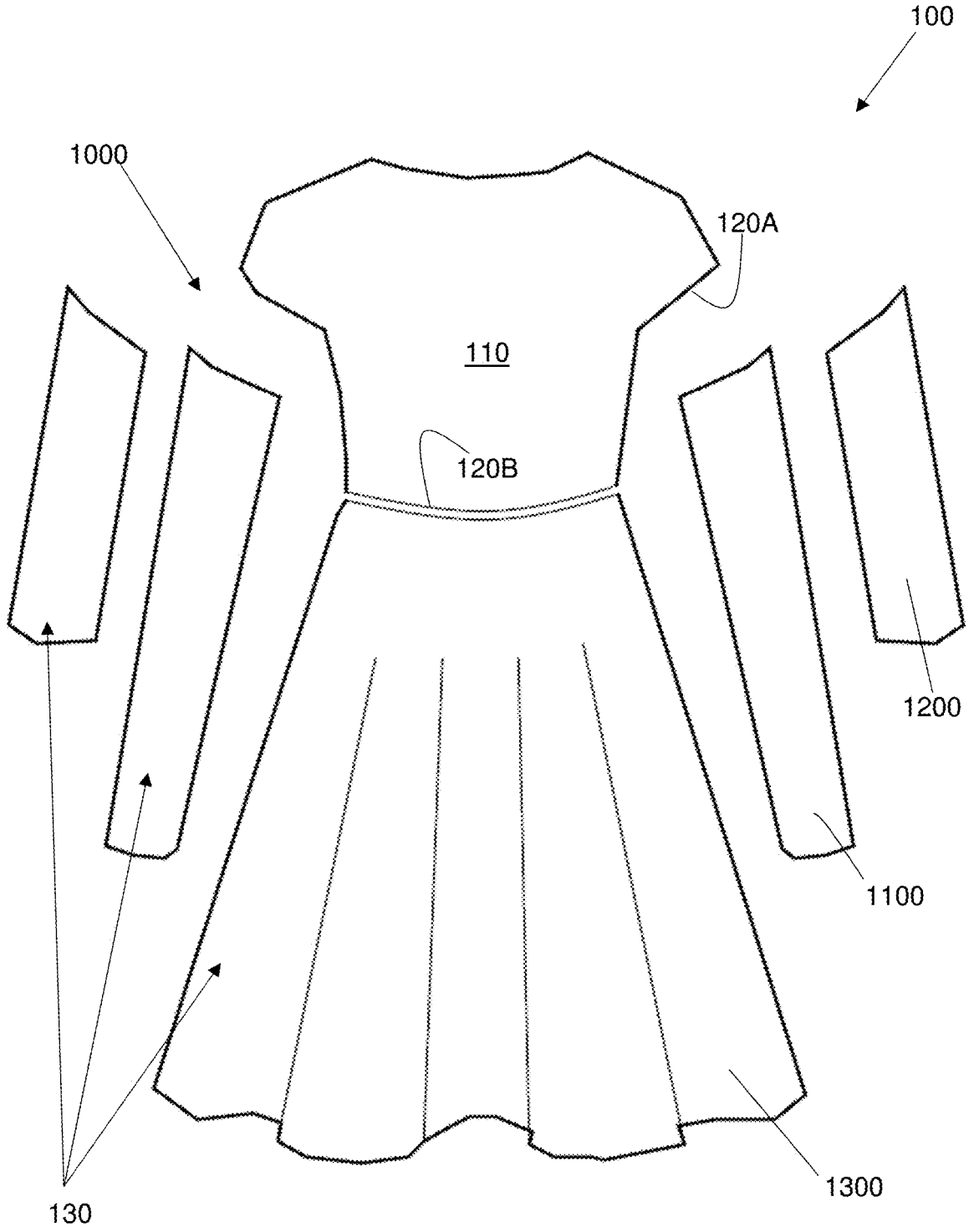
FIG. 7 is a schematic of a dress incorporating an adjustable fabric length system according to an embodiment of the present invention.

FIG. 7 shows a schematic of a dress (1000) incorporating an adjustable fabric length system (100) according to an embodiment of the present invention for adjusting various lengths of the dress (1000). For convenience, features that are similar or correspond to features of the preceding embodiment will be referenced with the same reference numerals.

The dress (1000) includes a fabric body (110) being the bodice having three edge portions (120). The dress (1000) further includes a plurality of extension pieces (130), including a pair of long sleeves (1100), a pair of three quarter sleeves (1200) and a skirt (1300).

In use, the system (100) enables a user to transform the dress (1000) as desired.

For example, in one scenario the user may desire a short sleeve dress (1000), in which case the user may selectively remove the sleeves (1100, 1200) from the respective outer edge portions (120A).

In another scenario, the user may desire a separate bodice (110) or skirt (1300), in which case the user may selectively remove the skirt (1300) from the respective outer edge portion (120B).

Conversely, in other scenarios, the user may reattach either the long sleeves (1100) or the three quarter sleeves (1200) or the skirt (1300) to the bodice (110), in which case the user may individually sew each desired extension portion (130) to a respective outer edge portion (120A, 1208) of the bodice (110).

Advantageously, the system (100) in this embodiment provides a dress (1000) that can be readily adapted by a user. The various extension pieces (130) may be selectively removed and reattached.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An adjustable fabric length system for adjusting a length of fabric, said system comprising:

a fabric body having at least one edge portion;

a plurality of extension pieces of fabric, each extension piece having an inner edge portion and an opposed outer edge portion, said plurality of extension pieces sewn together with one another and the fabric body in an edge portion to edge portion arrangement such that the plurality of extension pieces extend distally away from the at least one edge portion of the fabric body, each said extension piece being individually sewn to an adjacent said extension piece or the at least one edge portion with at least one release thread; and at least one tab operably associated with the at least one release thread of each of the plurality of extension pieces, said at least one tab releasably affixed to a respective said extension piece to cover an end of the at least one release thread and prevent the at least one release thread from being inadvertently pulled, wherein the length of fabric is adjusted by pulling or separating the at least one tab away from a selected said extension piece to uncover the at least one release thread associated with the selected said extension piece and pulling the at least one release thread uncovered to release and separate the selected said extension piece from the fabric body or the outer edge portion of a proximally arranged said extension piece.

2. The system of claim 1, wherein partially overlapping portions of the edge portions of adjacently arranged extension pieces and/or the fabric body are each releasably sewn together with the at least one release thread.

3. The system of claim 1, wherein the edge portions of adjacently arranged extension pieces and/or the fabric body are releasably sewn together with a loop stitch and a single said release thread.

4. The system of claim 3, wherein each extension piece is releasably sewn to an adjacent extension piece and/or the fabric body with two or more lines of loop stitches extending substantially parallel to one another.

5. The system of claim 4, wherein each line of loop stitches comprises the at least one release thread.

6. The system of claim 1, wherein the at least one tab is a pull tab or label attached to the end of the release thread and adapted to be pulled to thereby pull the at least one release thread.

7. The system of claim 1, wherein the at least one tab is separated or detached from the extension piece prior to pulling the at least one release thread associated with the selected said extension piece.

8. The system of claim 1, wherein the fabric body is a garment or part thereof and the at least one edge portion is an edge of the garment.

9. The system of claim 8, wherein the plurality of extension pieces each comprise a cuff configured to be releasably sewn together in the edge portion to edge portion arrangement to the edge of the garment.

10. The system of claim 8, wherein the plurality of extension pieces each comprise a strip forming a lower edge or hem of the fabric body and configured to be releasably sewn together in the edge portion to edge portion arrangement to the edge of the garment.

11. The system of claim 1, wherein the fabric body is a sheet of fabric and the at least one edge portion is an edge of the sheet of fabric.

12. The system of claim 1, wherein the length of fabric is shortened by pulling the at least one tab associated with a selected said extension piece to release and separate the selected said extension piece from the fabric body or the outer edge portion of a proximally arranged said extension piece.

13. The system of claim 1, wherein the length of fabric is lengthened by sewing at least one said extension piece to the fabric body, or the outer edge portion of a proximally arranged said extension piece, with at least one release thread.

14. A method of adjusting a length of fabric, said method comprising:

providing a fabric body having at least one edge portion and a plurality of extension pieces of fabric, each extension piece having an inner edge portion and an opposed outer edge portion, said plurality of extension pieces being sewn together with one another and the fabric body in an edge portion to edge portion arrangement such that the plurality of extension pieces extend distally away from the at least one edge portion of the body, each said extension piece individually sewn to an adjacent said extension piece or the at least one edge portion with at least one release thread and at least one tab operably associated with an end of the at least one release thread and releasably affixed to the extension piece to cover the end of the at least one release thread and prevent it from being inadvertently pulled; and separating or detaching the at least one tab from a selected said extension piece to be released and separated to uncover the at least release thread so that it can be pulled; and pulling the at least one release thread associated with the selected said extension piece and release and separate the selected said extension piece from the fabric body or the outer edge portion of a proximally arranged said extension piece.

15. The method of claim 14, wherein length of fabric is shortened through selective removal of one or more of the extension pieces.

16. The method of claim 14, wherein the pulling comprises identifying the at least one tab associated with the at least one release thread associated with the selected said extension piece.

17. The method of claim 14, wherein the pulling comprises pulling the at least one release thread entirely from the selected said extension piece to release and separate the selected said extension piece from the fabric body.

18. The method of claim 14, wherein the length of fabric is lengthened through selective addition of one or more said extension pieces releasably sewn to the fabric body or the outer edge portion of a proximally arranged said extension piece until a desired length is reached.

19. The method of claim 18, wherein the one or more said extension pieces are arranged in the edge portion to edge portion arrangement such that the one or more said extension pieces extend distally away from the at least one edge portion of the fabric body or the outer edge portion of a proximally arranged said extension piece.

* * * * *